United States Patent [19]

Cote

[11] Patent Number: 4,898,559

[45] Date of Patent: Feb. 6, 1990

[54] MACHINES FOR THE IMPLANTATION OF CATHODES IN CATHODE-RAY TUBE GUNS

[75] Inventor: Daniel Cote, Ampuis Condrieu, France

[73] Assignee: Videocolor, Montrouge, France

[21] Appl. No.: 295,388

[22] Filed: Jan. 10, 1989

[30] Foreign Application Priority Data

Jan. 13, 1988 [FR] France ..... 88 00295

[51] Int. Cl.[4] ..... H01J 9/06

[52] U.S. Cl. ..... 445/64; 445/67

[58] Field of Search ..... 445/3, 4, 34, 36, 63, 445/64, 67

[56] References Cited

U.S. PATENT DOCUMENTS

| | | | |
|---|---|---|---|
| 3,584,182 | 6/1971 | Volk et al. | 445/36 |
| 3,848,301 | 11/1974 | Gruber | 445/3 X |
| 4,015,315 | 4/1977 | Stone | 445/34 |

FOREIGN PATENT DOCUMENTS

| | | | |
|---|---|---|---|
| 3109056 | 12/1981 | Fed. Rep. of Germany . | |
| 2205738 | 5/1974 | France . | |
| 2592219 | 6/1987 | France . | |
| 196446 | 12/1982 | Japan | 445/67 |

OTHER PUBLICATIONS

Patent Abstracts of Japan, vol. 11, No. 73 (E-486) [2520], Mar. 5, 1987.

R.C.A. Technical Notes, No. 1322, Dec. 1982, pp. 1, 2, Princeton, New Jersey, R. E. Schlack et al.

Patent Abstracts of Japan, vol. 2, No. 10 (E-77), Jan. 25, 1978, p. 10299.

*Primary Examiner*—Kenneth J. Ramsey

*Attorney, Agent, or Firm*—Oblon, Spivak, McClelland, Maier & Neustadt

[57] ABSTRACT

Disclosed is a machine for the implanting of a cathode in an eyelet of a cathode-ray tube gun. This machine has a gun-supporting device which is movable along the axis of the gun, a cathode-supporting device positioning the cathode along the axis of the gun and a sensor with retractile rod which works together with a first detector, giving the position of the cathode when the rod rests on the grid G1, said sensor being capable of being shifted in a direction perpendicular to the axis of the gun. It further has a gauge rod, with a calibrated length, which rests on the grid G2 and ends at the side opposite to the eyelet, with a second detector recording the position of the gauge rod and a control device determining the shift of the gun-supporting device on the basis of the measurements made by the two detectors.

8 Claims, 2 Drawing Sheets

MACHINES FOR THE IMPLANTATION OF CATHODES IN CATHODE-RAY TUBE GUNS

BACKGROUND OF THE INVENTION

1. Field of the Invention

The present invention concerns machines for the implantation of cathodes in cathode-ray tube guns, and more precisely to an improvement for a machine described in the copending application having Ser. No. 07/169,952 filed Mar. 18, 1988 on behalf of the applicant, now U.S. Pat. No. 4,850,920.

2. Description of the Prior Art

Machines currently used to insert cathodes in the electron guns of cathode-ray tubes include, for the purpose of measuring the distance between the active face of the cathode and the gird G1 or, as the case may be, the grid G2, complicated instruments which are slow and hardly maintain the requisite precision.

For, the machines position the cathode with respect to the first grid, or grid G1, by first interposing a sensor with a fixed length between the cathode and the grid G1, said cathode being mounted on a fixed support and the gun being mounted on a moving support driven by a wheel that works in cooperation with the cam-shaped groove of a leading screw which is itself driven by a stepping motor.

A first level or shoulder of this cam-shaped groove defines the measurement position and the positional setting of the cathode. Then the gun is withdrawn, the sensor is released, and the gun goes forward by a distance equal to the distance by which it has been withdrawn, plus the length of the sensor. Thus we come to a position in which the cathode is soldered into the eyelet of the gun, this position being determined also by a shoulder of the groove. Thus, any modification in the setting of the machine means that the sensor has to be dismantled and re-machined to new dimensions. Furthermore, the feed device formed by a leading screw working together with a wheel, has little precision: the groove of the leading screw has to be free of all dust or debris, and this is difficult to obtain in an industrial environment. Moreover, even if the step motor stops precisely in the desired angular position, the coupling device with the leading screw that drives it has backlashes which are difficult to take into account. The stresses exerted on the wheel, as much by the gun carriage as by the leading screw, mean that the backlashes in this transmission of motion are reflected at the carriage. Furthermore, if the cathode eyelet is out of ine, there is a risk that the sensor will deform the eyelet, or else the sensor will have to be made of a deformable material.

To overcome these drawbacks, the French patent No. 87 03922 has proposed a machine for implanting a cathode in an eyelet of an electron gun, comprising a movable gun supporting device that moves in the direction of its axis, said device being movable between two fixed positions, and a sensor with a rectractile rod which can be moved perpendicularly to the axis of the gun.

In the case of the above-described implanting machine, when the gun-supporting device is placed in the position where it is at the furthest distance from the cathode, the sensor with a rectractile rod is inserted between the gun and the cathode. The rod of the sensor is then brought to a stop against the grid G1, and it is thus possible to define the distance between the sensor and the active face of the cathode. Thus, the active face of the cathode is positioned in such a way that when the sensor is removed and the gun-supporting device is brought to its second fixed position, the desired distance is obtained between the active face of the cathode and the grid G1. This machine for implanting a cathode in the eyelet of an electron gun thus enables precise positioning of the cathode with respect to the grid G1. However, it takes into account neither the position of the grid G2 nor the spacing between the grid G1 and the grid G2. Now, to obtain accurate functioning of a cathode-ray tube, the distance between the grids G1 and G2 should range between specific values so as to give a precise cut-off voltage.

It is an object of the invention is to overcome these drawbacks in proposing a cathode implanting machine for implanting a cathode in a cathode-ray tube gun eyelet making it possible to achieve, in one operation, the measurement of position of the grid G1, the grid G2 and the cathode.

SUMMARY OF THE INVENTION

Consequently, an object of the present invention is a machine for the implanting of a cathode in a cathode-ray tube gun eyelet, of a type comprising a device to support the gun, movable along the axis of the gun, a cathode-supporting device positioning the cathode in the axis of the gun and a sensor with a retractile rod, working together with a first detector giving the position of the cathode when the rod is supported on the grid G1, said sensor being movable perpendicularly to the axis of the gun, said machine further comprising a gauge rod, with a calibrated length, which rests on the grid G2 and opens out on the side opposite to the eyelet, with a second detector recording the position of the gauge rod and a control device, determining the shift of the gun-supporting device through the measurements made by the two detectors.

According to a preferred embodiment, the first detector is formed by an electromagnetic sensor, while the second detector is formed by a sensor, with optical sighting, that prepares a measuring signal.

Furthermore, the sensor is mounted so that it is axially movable at the end of a L-shaped arm which carries, at its other end, the second detector said arm being movable perpendicularly to the gun/cathode axis.

According to another characteristic of the present invention, the cathode-supporting device is fixed along the axis of the gun, but is movable in a substantially perpendicular direction with respect to the axis of the gun.

Furthermore, the sensor with retractile rod is preferably made as described in the French patent application No. 87 03922. Thus the sensor has a cylinder in which there moves a piston. To this piston, there is fixed a sensor rod which opens out onto an end of the cylinder and is designed to come into contact with the grid G1 of the gun, the other end of the sensor having a detector. When the sensor is placed in the axis of the gun and when the piston is at a stop against the end by which the rod exits, this detector detects the position of the active of the cathode which is also positioned in the axis of the gun.

BRIEF DESCRIPTION OF THE DRAWINGS

Other characteristics and advantages of the present invention will emerge from the following detailed description of an embodiment, made with reference to the following figures, wherein.

To simplify the description, the same references are repeated for the same elements in the figures.

DESCRIPTION OF A PREFERRED EMBODIMENT

Figure 1:
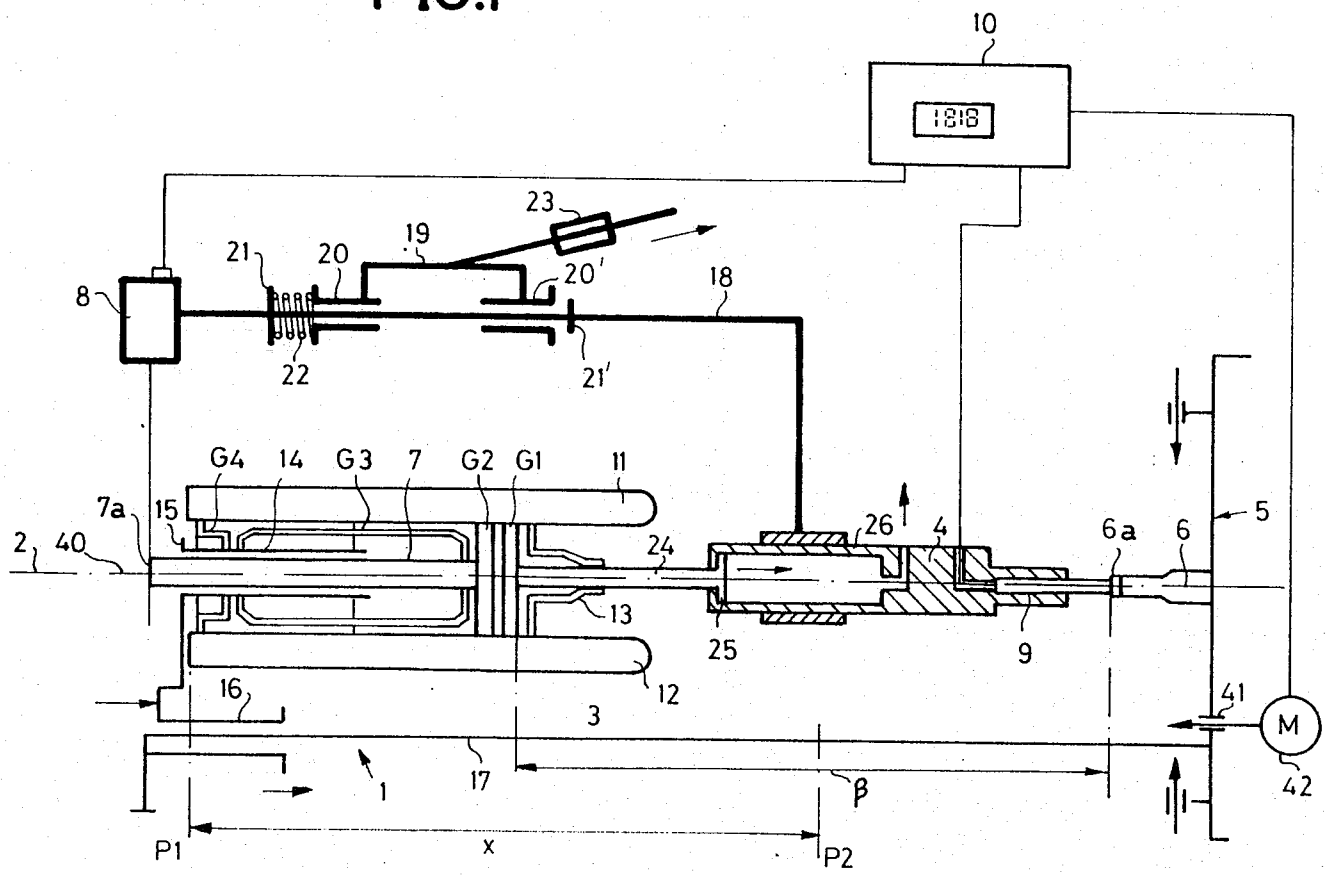
FIG. 1 is a simplified diagram of a machine according to the present invention and, FIG. 2 is a sectional view of a sensor used in FIG. 1.

Although FIG. 1 shows a simple gun, it is clear that, to those skilled in the art, the invention can also apply to a triple gun for a trichromatic cathode-ray tube.

FIG. 1 shows a schematic view of an implanting machine according to the present invention. This machine has a supporting device 1 for an electron gun 3 for a cathode-ray tube which is movable along an axis 2, a sensor 4 with a rectractile rod, a supporting device 5 for a cathode 6, a calibrated gauge rod 7, position detectors 8 and 9 and a control device 10, determining the shift of the gun-supporting device on the basis of the measurements made by the two detectors.

The gun 3 of the cathode-ray tube, used in the embodiment shown in FIG. 1, is formed by four grids marked G1, G2, G3 and G4, fixed to two ceramic supporting elements 11, 12. It is clearly understood that the invention can apply to guns with a different number of grids, especially guns with six grids. The gun 3 also has a cathode-carrying eyelet 13. The machine of the invention is used to insert the cathode 6 in the eyelet 13 in such a way that the rear face 6a of the cathode, namely the face to which the emissive substance is applied, is at a determined distance from the grid G1. Once the cathode has been positioned, it is soldered into the eyelet 13. The cathode 6 is mounted on a supporting device 5 which is fixed along the axis 2 but is movable in a direction which is substantially perpendicular to the axis 2, so that the cathode can be positioned along this axis.

The gun is deposited on a supporting device 1, which is movable in a direction parallel to the axis 2. The cathode-supporting device consists of a sleeve 14, with an external diameter which is slightly smaller than the diameter of the holes for the passage of electrons from the grids G2 and G4. This sleeve 14 is provided, at one of its ends, with a collar 15. The collar 15 is joined to a movable bearing 16 which moves on a fixed guide 17 which is parallel to the axis 2. The bearing 16 is driven by a motor (not shown).

The sensor 4, with a general cylindrical shape, is mounted at the end of a supporting arm 18 which can be moved perpendicularly to the axis 2, between a measurement position for which the axis of the sensor is identified with the axis 2, as shown in FIG. 1, and a released position. As shown in FIG. 1, the arm 18 is supported, in a sliding position, by a U-shaped arm 19 carrying, at its two ends, sleeves 20 and 20' positioned between two stops 21 and 21' which are solidly joined to the arm 18, with an interposed spring 22 between the sleeve 20 and the stop 21. The arm 19 can be shifted perpendicularly to the axis 2, by using a spring device 23 or any other similar device. Furthermore, the sensor 4 essentially has a rectractile measuring rod 24, moved by a piston 25 which is shifted in the chamber formed by the cylindrical body 26 of the sensor. The sensor further has, at its other end, a detecting device 9 which, in the measuring position, faces the active surface 6a of the cathode 6. In the released position, the measuring rod 24 of the sensor is retracted. When the sensor 4 reaches the measuring position, its rod is out so as to come into contact with the first grid G1 of the gun 3.

The sensor used within the framework of the present invention may be identical to the sensor described in the French patent No. 87 03922. This sensor is shown in a detailed way in FIG. 2. In this figure, the sensor is shown in the measuring position. The sensor device described herein is of the pneumatic control type but it is clear to those skilled in the art that the invention is not limited to a sensor of this type and that any sensor fulfilling the same function, namely using a rectractile rod to measure the distancece between the first grid of the gun and the cathode, can be suitable. Feelers of this type may be controlled by electromagnetic, hydraulic or other means.

The body 26 of the sensor 4 is mounted so that it is movable in axial translation with respect to the supporting arm 18, by means of a ball bearing 27. This translation is restricted, on one side, by a shoulder 28 of the body 26 and, on the other side, by an elastic spring 29, placed around the body 26 and supported against a capping collar 30 screwed into the end of the body 26. The capping collar 30 lets through the rod 24 non-imperrviously, and acts as an adjustable stop to the piston 25. The other end of the body 26 is closed. An elastic spring 31 is placed inside the body 26, resting on the closed end, and prevents the piston 25 from abutting this end too suddenly when it makes its withdrawal movement.

Near its end on which the spring 31 rests, the body 26 of the sensor is pierced with a radial hole 32, connected to a pneumatic control device (not shown). The closed end of the body 26 has a cavity 33 wherein there is mounted a detector, namely an electromagnetic sensor 9, used to determine the distance 6*a*-G1. In fact, the sensor 9 will determine the extent to which the rod 9*a*, pushed by the spring 9*b* against the front face of 6*a* of the cathode, is pushed in. This type of detector is known per se and shall not be described in greater detail. Other types of detectors may be used, notably detectors of the type described in the patent application FR No. 87 03922.

Figure 2:
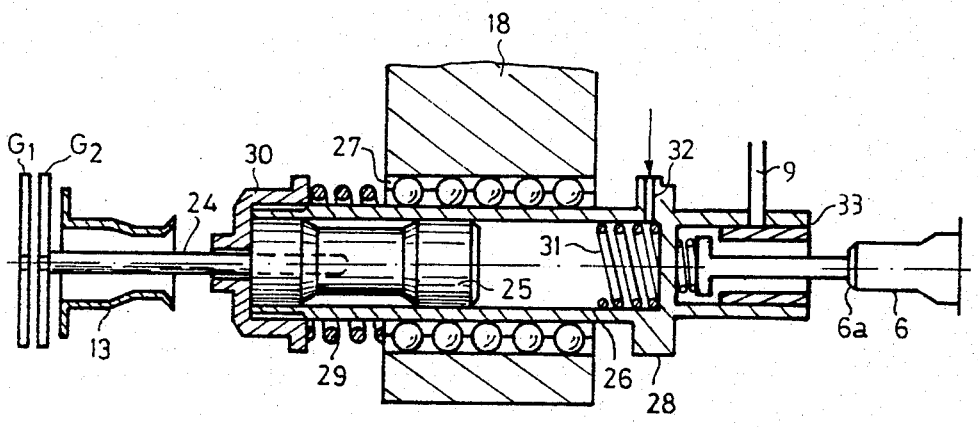

As shown in FIG. 2, in the measuring position the piston 25 comes to a stop against the capping collar 30, with its rod 24 resting on the first grid G1 of the gun 3. When the sensor is in the position shown in FIG. 1 with its rod 24 resting on the grid G1, it forms a calibrated gauge rod and thus makes it possible to determine the distance of the cathode from the grid G1 in using the electromagnetic sensor 9. The information coming from the sensor 9 is sent to the control device 10 which prepares a command that positions the stop 41.

The sensor is actuated by a control device which may be of the type described in the French patent application No. 87 03922. Consequently, this pneumatic type of control device shall not be described again herein.

Furthermore, according to the present invention, a gauge rod 7, with a diameter smaller than the internal diameter of the sleeve 8 and with a length greater than the distance between G2 and the end of the gun on the grids G4 or G6 side, is movable along the axis 2. Preferably the gauge rod 7 is inserted into the gun when the sleeve 16 is itself inserted into the gun, with the collar 15 being stopped against the bead 12. This gauge rod 7 is actuated by a suitable auatomatic mechanism (not shown). A spring 40 or similar device then applies the gauge rod against the grid G2.

A position detector 8, for example an sensor with optical sighting, which prepares an electrical measurement signal, determines the position of the free front face 7a at the gauge rod 13. The electrical measurement signal is sent to a control and display device 10, which receives the signal emitted by the detector 9. According to the present invention, the detector 8 is placed at the end of the arm 18, opposite to the end supporting the sensor 4. It determines the position of the face 7a of the gauge rod 7 when the gun 3 is in the withdrawn position P1, as shown in FIG. 1, so that the sensor 4 can be inserted in the measuring position. Since the detector 8 and the sensor 4 are placed at each end of one and the same arm 18, the two detectors 8 and 9 will thus be in an aligned position along the axis 2.

The electrical signals produced by the detectors 8 and 9 are sent to a control and display device 10 which uses these signals to determine the value of the shift of the stop 41. This stop 41 actually determines the final position of the gun-supporting device, namely the position for which the cathode 6 occupies its normal position in the eyelet 13, i.e. when the face 6a of the cathode is at the requisite distance from the grid G1. In fact, the control device 10 sends a control signal to the motor 42 which shifts the stop.

With the above-described machine, first of all the standard position of the stop for a gun and a reference cathode, which have been previously measured and chosen, is determined. Thus, we obtain the standard distance Y of the shifting of the gun-supporting device of the gun, and this gives the standard position of the stop.

When any guns and cathodes are used with the above-described machine, the detectors 8 and 9 respectively measure deviations X1 and X2 with respect to the measurements performed previously with the reference elements. These deviations may be positive or negative, and determine the variation of the stop position.

It is then easy for those skilled in the art to make a control device 10 controlling the motor 42 so that it makes a shift corresponding to this variation.

In the above-described machine, the detectors 8 and 9 take into account variations in distance between the grid G1 and the grid G2, and enable the cathode to be positioned with respect to the grid G1 in a position corresponding to a previously determined value.

Thus, the final positioning of the cathode takes place by means of a shifting of the ceramic supporting elements by a value x such that:

$$x=\beta-(\text{desired final distance KG1})-f(G1G2)$$

where $\beta$=value measured between the lower edge of G1—and the face 6a of the cathode in the measurement phase.

f(G1G2)=linear function depending on the type of gun used (for example, with 4 grids or 6 grids).

For example, the sensitivities of a gun with 6 grids are:

+ for KG1, a value $\gamma$ of cut-off voltage variation,

+ for G1 G2 a value $\delta$ of cut-off voltage variation:

a measurement of G1G2 greater than the nominal value by one-thousandth of an inch (i.e. 2.54-thousandths of a centimeter) will therefore imply positioning the cathode at a distance of about $\delta/\gamma$ thousandths of an inch (namely 2.54 $\delta/\gamma$ thousandths of a centimeter) less than the nominal value.

Of course the machine of the invention furthr has a device to solder the cathode 6 into the eyelet 13, for example a device for soldering by laser rays. This soldering device is well known per se and, since it does not form part of the invention, shall not be described again.

What is claimed is:

1. A machine for the implanting of a cathode in a caathode-ray tube gun eyelet, of a type comprising a device to support the gun, movable along the axis of the gun, a cathode-supporting device positioning the cathode in the axis of the gun and a sensor with a retractable rod, working together with a first detector giving the position of the cathode when the rod is supported on the grid G1, said sensor being movable perpendicularly to the axis of the gun, said machine further comprising a gauge rod, with a calibrated length, which rests on the grid G2 and opens out on the side opposite to the eyelet, with a second detector recording the position of the gauge rod and a control device, determining the shift of the gun-supporting device through the measurements made by the two detectors.

2. A machine according to claim 1, wherein the first detector consists of an electromagnetic sensor.

3. A machine according to claim 1, wherein the second detector consists of a sensor with optical sighting preparing a measurement signal.

4. A machine according to claim 1, wherein the sensor is mounted so that it is movable axially at the end of an L-shaped arm carrying, at its end, the second detector, said arm being movable in a direction perpendicular to the axis of the gun.

5. A machine according to claims 1, wherein the cathode-supporting device is fixed along the gun axis but is movable in a direction which is substantially perpendicular to this axis.

6. A machine according to claim 1, wherein the gun-supporting device has a sleeve with a diameter smaller than that of the holes of the grids other than the first two grids, said sleeve having a collar which rests against the ceramic supporting elements when the sleeve is fully inserted into the gun, said collar being solidly joined to the control device for the shifting of the gun-supporting device.

7. A machine according to claim 1, wherein the sensor has a cylinder in which there is moved a piston, to which there is fixed a sensor rod ending at one end of the cylinder and designed to come into contact with the first grid G1 of the gun, the other end having a second detector which, when this sensor is placed in the axis of the gun and the piston is at a stop against the end by which the rod comes out, determines the position with respect to the active face of the cathode placed in the axis of the gun.

8. A machine according to claim 1, wherein the length of the shift made by the gun-supporting device is determined by an adjustable stop controlled by the control device.

* * * * *